US005373793A

United States Patent [19]

Crossman

[11] Patent Number: 5,373,793

[45] Date of Patent: Dec. 20, 1994

[54] ADAPTOR HOUSING FOR MOUNTING AN ADJUSTABLE HEIGHT WORK SURFACE TO A WALL PANEL

[75] Inventor: Philip E. Crossman, Holland, Mich.

[73] Assignee: Leggett & Platt, Incorporated, Carthage, Mo.

[21] Appl. No.: 9,545

[22] Filed: Jan. 26, 1993

[51] Int. Cl.[5] ..... A47B 23/00

[52] U.S. Cl. ..... 108/42; 108/48

[58] Field of Search ..... 108/42, 147, 47, 48, 108/50; 52/27, 36.1, 36.4, 36.5

[56] References Cited

U.S. PATENT DOCUMENTS

| | | | |
|---|---|---|---|
| 3,039,727 | 6/1962 | Engel, Jr. et al. . | |
| 3,042,978 | 7/1962 | Eames et al. . | |
| 3,043,640 | 7/1962 | Eames et al. . | |
| 3,294,351 | 12/1966 | Rollins, Jr. . | |
| 3,759,297 | 9/1973 | Anderson et al. . | |
| 3,966,158 | 6/1976 | Boundy . | |
| 4,018,019 | 4/1977 | Raith et al. . | |
| 4,222,542 | 9/1980 | Wilson et al. . | |
| 4,515,087 | 5/1985 | Kurrasch . | |
| 4,549,712 | 10/1985 | Simon et al. . | |
| 4,619,208 | 10/1986 | Kurrasch . | |
| 4,650,143 | 3/1987 | Kurrasch . | |
| 4,762,072 | 8/1988 | Boundy et al. | 108/50 |
| 4,881,471 | 11/1989 | Schwartz et al. . | |
| 4,914,873 | 4/1990 | Newhouse | 52/36.1 |
| 4,969,403 | 11/1990 | Schwartz et al. . | |
| 4,987,835 | 1/1991 | Schwartz et al. . | |
| 5,083,514 | 1/1992 | Schwartz et al. . | |
| 5,199,778 | 4/1993 | Aoki et al. | 108/157 X |

FOREIGN PATENT DOCUMENTS

| | | | |
|---|---|---|---|
| 0006707 | 1/1980 | European Pat. Off. | 108/50 |

*Primary Examiner*—Jose V. Chen

*Attorney, Agent, or Firm*—Varnum, Riddering, Schmidt & Howlett

[57] ABSTRACT

An adaptor housing assembly for mounting an adjustable height work surface to a wall panel of an open office furniture system. The wall panel has a pair of vertical slotted standards which are adapted to receive the hooks of a mounting bracket. The adaptor housing assembly mounts a height adjustable work surface to the vertical slotted standards of the wall panel by clamping a mounting bracket to an adaptor housing in which is mounted a height adjustment mechanism having a frame which is connected to the work surface. The adaptor housing is fixed with respect to the wall panel and the frame of the height adjustment mechanism moves vertically with respect to the wall panel to raise and lower the work surface. The channel guides the moving members of the mechanism to which the work surface is mounted. The adaptor housing has a pair of elongated flanges extending outwardly from one end of the adaptor housing to form a slot which receives an elongated plate having tapped holes. The mounting bracket is affixed to the adaptor housing by screws passing through the mounting bracket and into tapped holes in the elongated plate, thereby clamping the mounting bracket to the adaptor housing as the screws are tightened. The hooks of the mounting bracket engage the vertical slotted standards and support the adaptor housing to which the work surface is mounted by the height adjustment mechanism.

24 Claims, 6 Drawing Sheets

ADAPTOR HOUSING FOR MOUNTING AN ADJUSTABLE HEIGHT WORK SURFACE TO A WALL PANEL

BACKGROUND OF THE INVENTION

1. Field of the Invention

This invention relates to a housing for mounting an adjustable height work surface to a wall panel. In one of its aspects, the invention relates to an adaptor housing incorporating a height adjustable mechanism and which mounts a variety of different mounting brackets for mounting an adjustable height work surface to a wall.

2. Description of the Related Art

A typical open office furniture system comprises a series of wall panels connected together at the edges thereof. The wall panels normally have at each edge slotted vertical standards which provide vertical hanging intelligence for mounting work surfaces, shelves and other similar accessories to the wall panels with mounting brackets. The mounting brackets typically have several hooks which when inserted into the slots of the vertical standards are supported by the vertical standards as the brackets are moved downwardly.

Unfortunately, most OEM office panels use a different type of mounting bracket and vertical standard. Usually, the number and shape of the hooks of the mounting bracket vary with the different manufacturer. The spacing and size of the slots associated with the vertical standards will also vary with the manufacturer. Therefore, it is difficult to manufacture accessories which will mount to all the office wall panels made by the different manufacturers. Thus, a special model for each manufacturer must be made. Thus, the cost of making accessories is higher and the flexibility of the office panel systems is reduced. Therefore, it has long been desired to provide a mounting means which can mount the same accessory to a wall panel regardless of the manufacturer.

There are many ways for mounting accessories to the wall panels of a typical office partition system, especially vertically adjustable work surfaces. For example, U.S. Pat. No. 4,881,471, to Schwartz et al., issued on Nov. 21, 1989, discloses a retrofitable vertically adjustable work surface which is mounted to an office wall panel through two telescoping pairs of vertical rails. Hooks extend from a second pair of vertical rails which mount in the slots of vertical standards in the wall panels. U.S. Pat. No. 4,619,208, to Kurrasch, issued on Oct. 28, 1986, discloses a work surface which is mounted to a wall panel for vertical adjustment by a mounting bracket having two opposed sets of hooks. One set of hooks engages the slots in the work surface and the other set engages the slots of the vertical standard. U.S. patent to Engel et al., U.S. Pat. No. 3,039,727, issued Jun. 19, 1962 discloses a bracket for mounting a shelf to a vertical post having a T-shaped slot. The bracket is slidably movable within the T-shaped slot and is fixed at the desired position by a nut. The shelf engages the upper portion of the bracket.

Heretofore, each solution has required a mounting bracket which is especially constructed to meet the dimensions of each OEM. There has been no universal means for mounting an accessory such as a vertically adjustable work surface, to the slotted vertical standards of a variety of the different office panel systems made by different OEMs.

SUMMARY OF THE INVENTION

The adaptor housing assembly according to the invention mounts a height adjustable work surface to a wall panel of an open office system. The wall panel has a pair of vertical slotted standards which are adapted to engage a mounting bracket which mounts to the adaptor housing assembly. The adaptor housing assembly comprises an adaptor housing which preferably has an elongated profile. The adaptor housing has a pair of opposed sides and a pair of opposed ends which together form a channel to mount a height adjustment mechanism. The adaptor housing assembly further comprises an elongated plate shaped to slidably mount within the adaptor housing and which is adapted to affix the mounting bracket to the adaptor housing.

Preferably, the elongated plate is received within a slot formed by a pair of elongated flanges which extend outwardly from one of the opposed ends of the adaptor housing. The elongated plate has tapped holes to receive screws to mount the mounting bracket to the adaptor housing. A third elongated flange can be mounted on the opposed end adjacent the pair of elongated flanges to form a second slot in which to mount the elongated plate. Preferably, the flanges are shaped to form slots having a T-shape and the adaptor housing is extruded.

In another embodiment, a height adjustable work surface assembly is mountable to a wall having a pair of vertical slotted standards. The height adjustable work surface assembly comprises a work surface, a height adjustment mechanism for raising or lowering the work surface, a mounting bracket having mounting hooks for engaging the slots on the vertical slotted standards and an adaptor housing for mounting the height adjustment mechanism to the mounting bracket. The adaptor housing has a profile for receiving the height adjustment mechanism and for affixing mounting brackets of different configurations. A fastening member affixes the mounting bracket to the adaptor housing whereby the height adjustable work surface can be mounted to vertical standards of different configurations. The same bracket can be used on the left or right side of the work surface.

BRIEF DESCRIPTION OF THE DRAWINGS

The invention will now be described with reference to the drawings in which.

DETAILED DESCRIPTION OF THE PREFERRED EMBODIMENTS

Figure 1:
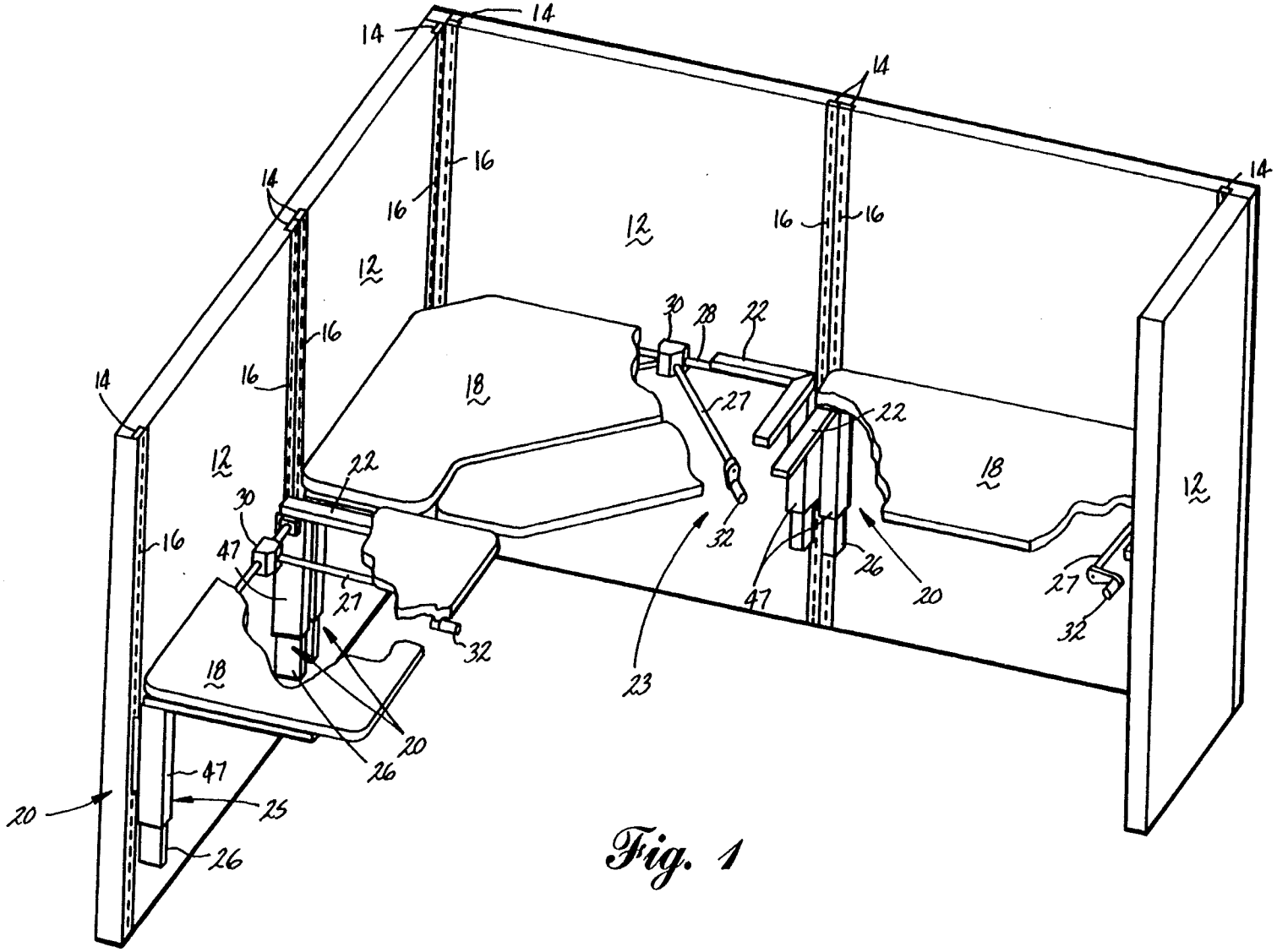
FIG. 1 is a perspective view of an office panel system incorporating the adaptor housing according to the invention.

FIG. 1 illustrates a typical office panel system 10, which forms the environment for the subject matter of the invention. The office panel system 10 comprises multiple wall panels 12 which are connected together at their sides. Each wall panel 12 has a vertical standard 14 disposed near each side of the wall panel and has a plurality of slots 16 for mounting a variety of accessories such as the work surfaces 18. Alternately, the adjacent panels 12 may share a vertical member between them (not shown) having one or more rows of slots. The work surfaces 18 are vertically adjustable and mount to the wall panels 12 by multiple applications of mounting systems 20.

Figure 2:
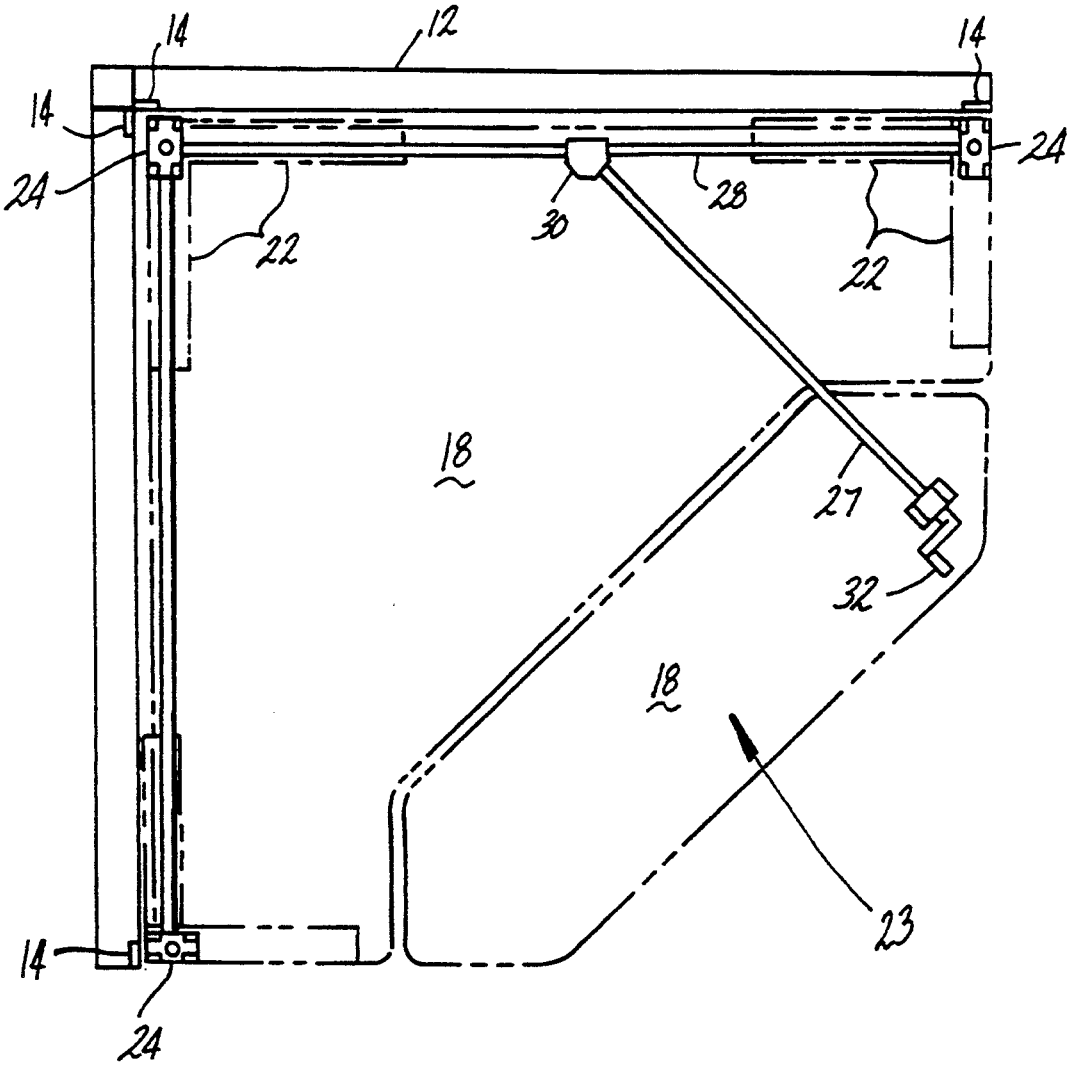
FIG. 2 is a top view of a portion of the office panel system of FIG. 1.

The mounting systems 20 are illustrated generally in FIGS. 1 and 2 and comprises support arms 22, height adjustment system 23 and adaptor housing 26 in accordance with the invention. The work surfaces 18 are rigidly connected to the support arm 22 which are mounted to the height adjustment system 23.

The height adjustment system 23 further comprises height adjustment mechanism 24, drive shaft 27, gear boxes 30 and hand-crank 32. An electric motor (not shown) can be used in lieu of a hand-crank. Generally, at least two height adjustment mechanisms 24 are used per work surface 18 to properly support the work surface. In corner applications, three height adjustment mechanisms 24 are typically used.

The height adjustment mechanisms 24 are interconnected via transfer shafts 28 between gear boxes 30. The hand-crank 32 or electric motor is connected to one gear box 30 by a drive shaft 27. A through shaft gear head electric motor can alternatively be directly connected in-line with one of the transfer shafts 28 if desired. Alternatively, a motor may be positioned to drive one of the transfer shafts via belts and pulleys or chain and sprockets. The end of the transfer shafts 28 adjacent the height adjustment mechanism 24 have bevel gears 35 which engage mating gears 48 in the gear box 30 of the height adjustment mechanism 24 as shown in FIG. 3.

Figure 3:
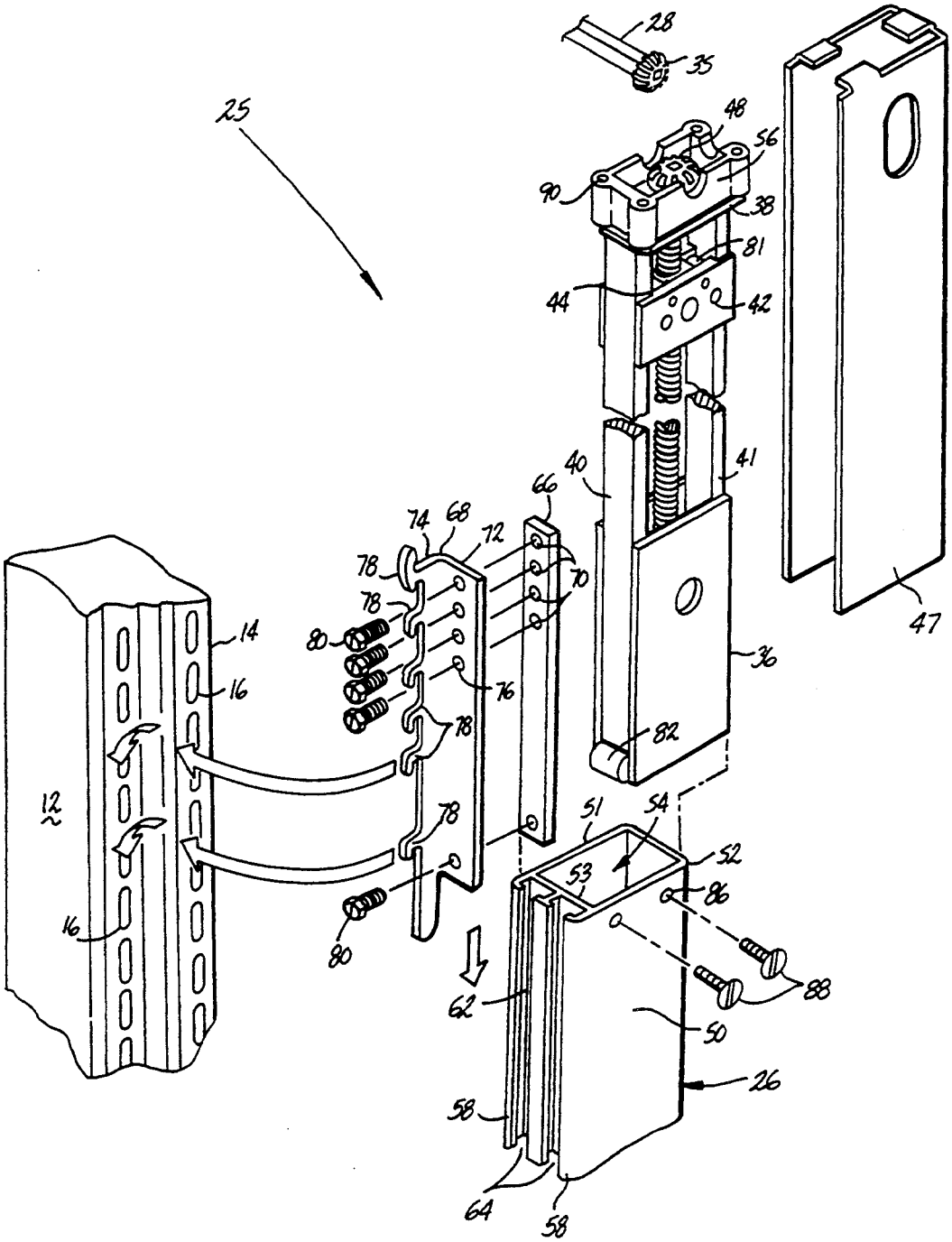
FIG. 3 is an exploded view of the adaptor housing according to the invention.
Figure 4:
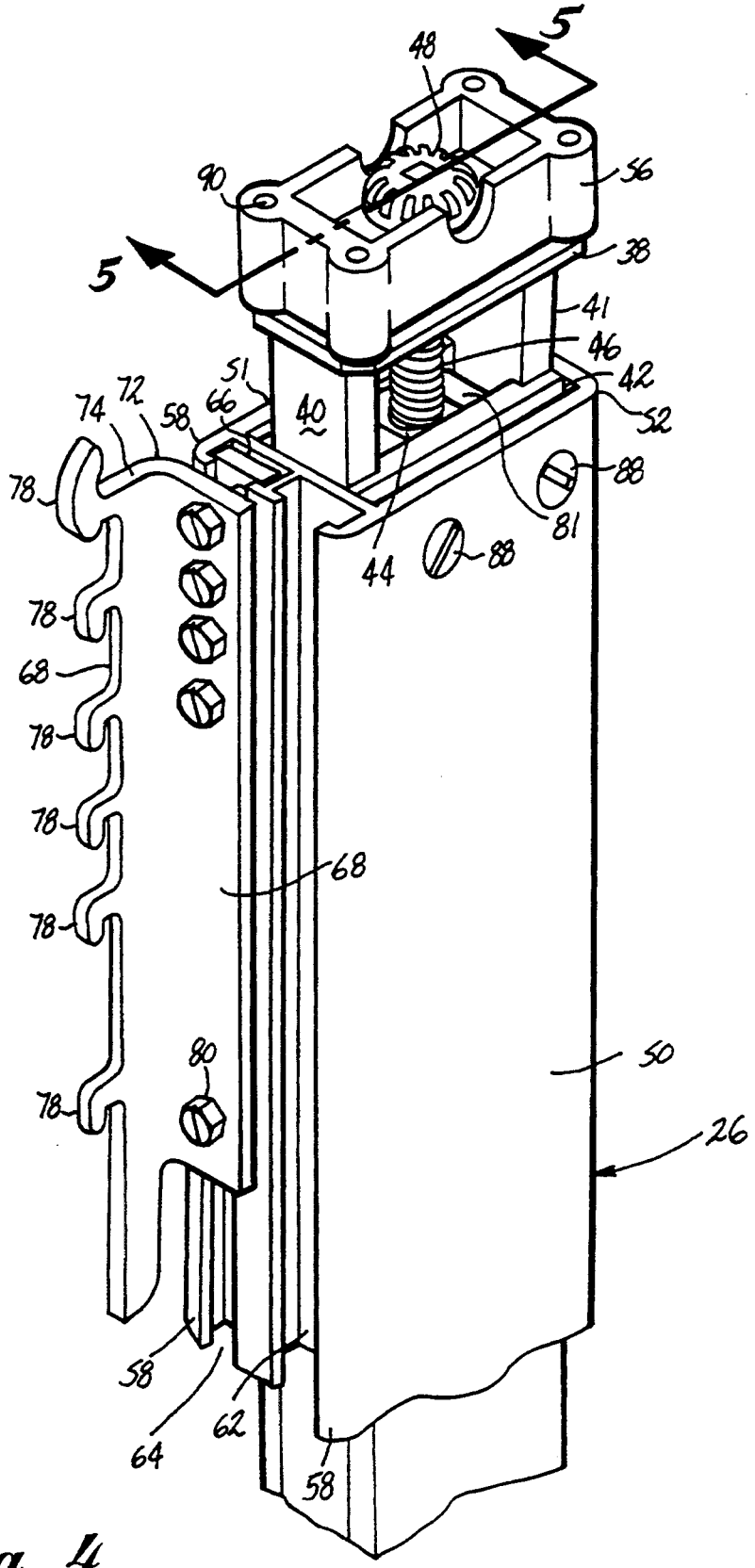
FIG. 4 is an assembled perspective view of the adaptor housing according to the invention.
Figure 5:
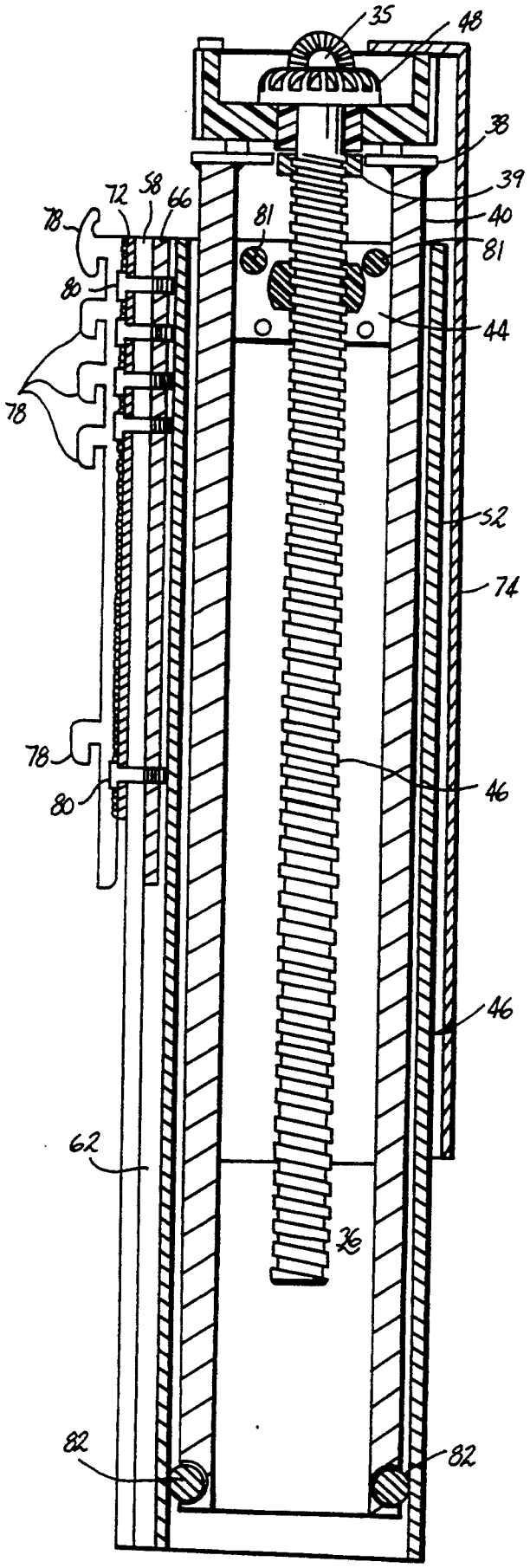
FIG. 5 is a sectional view along line 4—4 of FIG. 4.

FIGS. 3–5 illustrate the height adjustment mechanism 24 and adaptor housing assembly 25. The height adjustment mechanism 24 has frame plates 36 which are rigidly connected to a top plate 38 by opposed rails 40, 41. A gear housing 56 is fixed to top plate 38. A pair of trunnion plates 42 are slidably connected to the opposed rails 40, 41 and have a pair of rollers 81 bearing on the inner surface of opposed rails 40 and 41. A pivoted trunnion nut 44 is mounted to and between trunnion plates 42 and threadably receiving a drive screw 46. One end of the drive screw 46 extends through the bottom of the top plate 38 via a thrust bearing 39 and has fixed at its upper end a mating gear 48 which meshes with the bevel gear 35 of the transfer shaft 28. The drive screw 46 is threadably connected to the adaptor housing 26 via the trunnion nut 44 and the trunnion plates 42. A cosmetic shroud 47 is mounted to the gear housing 56 for movement therewith. Rollers 82 are rotatably mounted between and to the plates 36 to guide the movement of a lower portion of the height adjustment mechanism 24. The height adjustment mechanism is shown for illustration purposes only and does not form part of the invention. Any suitable height adjustment mechanism can be used.

The adaptor housing assembly 25, according to the invention, comprises an adaptor housing 26 which slidably mounts a clamping plate 66. The adaptor housing 26 has opposed sides 50, 51 and opposed ends 52, 53, all of which define a channel 54 in which the height adjustment mechanism 24 can be slidably received. Preferably, the adapter bracket 26 has an extruded elongated profile. The opposed sides 50, 51 each have an L-shaped flange 58 which extends beyond the end 53 and are directed inwardly of the opposed sides 50, 51. A T-shaped flange 62 extends outwardly from the opposed end 53. The L-shaped flanges 58 and T-shaped flange 62 define parallel T-slots 64.

The clamping plate 66 is generally rectangular in shape and has plurality of threaded openings 70. The clamping plate 66 is slidably received in the T-slots 64.

The adaptor housing 26 and clamping plate 66 are used in combination with a particular OEM mounting bracket 68 to mount the adaptor housing 26 to a wall panel 12. The mounting bracket 68 further comprises a first arm 72 and a second arm 74. The first arm 72 has a plurality of openings 76 which correspond to the threaded openings 70 of the clamping plate 66. The second arm 74 is usually perpendicular to the first arm 72 and has a plurality of mounting hooks extending from the edge of the second arm 74. The hooks are typically L-shaped, but can be T-shaped or any other desired shape.

Many different types of mounting brackets 68 are used by different manufacturers. The mounting bracket 68 is shown for illustration purposes only and is not part of the invention. According to the invention, mounting brackets having different configurations can be used with the adaptor housing 26. The clamping plate 66 has holes 70 corresponding to the holes 76 of a particular OEM mounting bracket 68 and thereby provides a means in the adaptor housing assembly 25 for mounting a variety of mounting brackets 68 to the adaptor housing 26 with the clamping plate 66 and screws 80.

Figure 6:
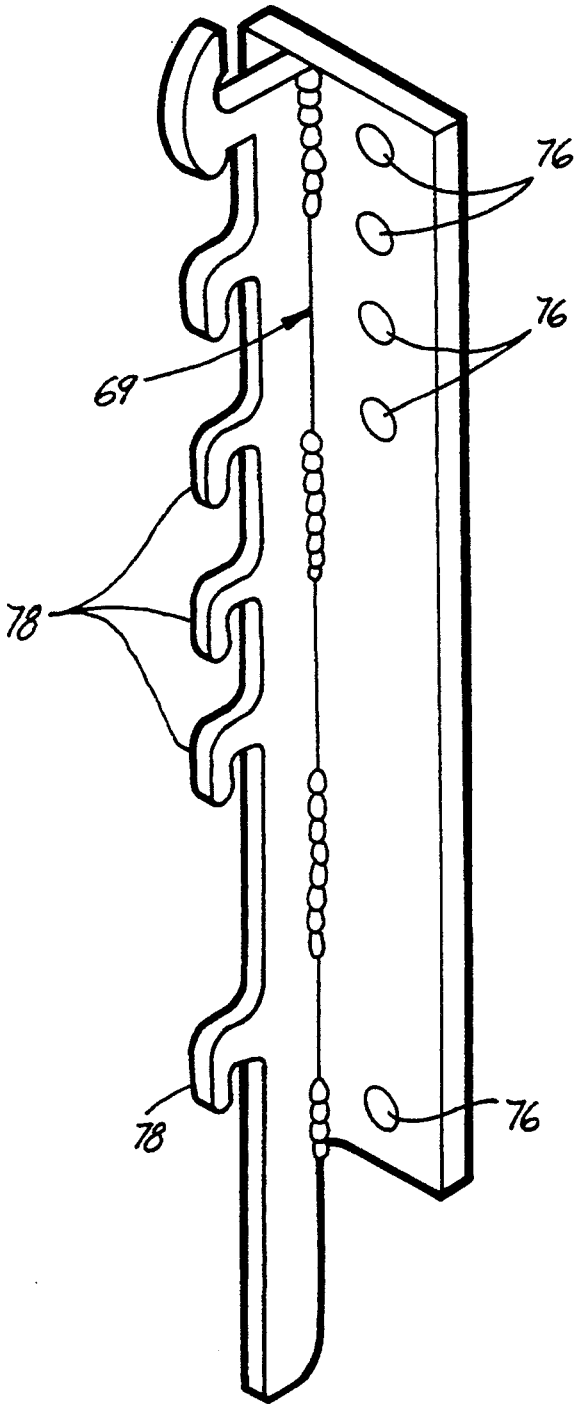
FIG. 6 is a perspective view of an alternate embodiment.

In some cases, the physical structure of the mounting bracket 68 may prevent the use of screws to clamp the bracket 68 to the clamping plate 66. In these cases, an alternative mounting bracket 69 (FIG. 6) can be used. The alternative mounting bracket 69 uses other methods, such as welding, to affix the mounting bracket 69 to a plate 71 which has a plurality of holes 76 suitable for clamping the flanges 58 and 62.

Referring to FIGS. 4–5, to assemble the mounting system 20, the mounting bracket 68 is mounted to the adaptor housing 26 by clamping plate 66. The clamping plate 66 is slidably inserted into one of the T-slots. The openings 76 of the mounting bracket 68 are aligned with the threaded openings 70 of the clamping plate 66 and the screws 80 are inserted through the openings 76 and threaded into the openings 70. Alternatively, the mounting bracket 26 can be loosely pre-assembled to plate 66 with screws 80 and then inserted into the T-slots 64 and positioned vertically to a preferred location and securely clamped by tightening screws 10.

As the screws 80 are tightened, one of the L-shaped flanges 58 and the T-shaped flange 62 are clamped between the clamping plate 66 and mounting bracket 68, securing the mounting bracket to the adaptor housing 26. If necessary, the T-slots are of sufficient length that the mounting bracket 68 can be slidably adjusted within the length of the T-slot to obtain the desired position of the mounting bracket 68 with respect to the adaptor housing 26. The mounting bracket 68 can be mounted within either T-slot 64 for mounting the adaptor housing 26 to either left or right sides of the wall panel 12. Similarly, some existing brackets may require the use of alternate T-slots because of their shape.

The height adjustment mechanism 24 is mounted to the adaptor housing 26 by slidably inserting the frame assembly 36 of the height adjustment mechanism 24 into the channel 54 of the adaptor 26. The wheels 82 contact and ride along the surfaces of the channel 54. The frame assembly 36 is inserted into the channel 54 until the openings 84 of the trunnion plate 42 align with the openings 86 of the adaptor housing 26. Screws 88 are inserted through the openings 86 and threaded into the threaded openings 84 of the trunnion plate 42 to mount the height adjustment mechanism 24 to the adaptor housing 26.

The gear housing 56 has threaded holes 90 which are used to secure the gear housing 56 to support arms 22. The work surfaces 18 are mounted to the support arms 22 which effectively mount the work surfaces to the height adjustment mechanism 24.

To mount the work surfaces 18 and the height adjustment mechanism 24 to the wall panels 12 of the office panel system 10, the mounting bracket 68 is connected to the adaptor housing 26 by the clamping plate 66 and screws 80 as disclosed above. The adaptor housing 26 is then mounted to the wall panel 12 by inserting the hooks 78 of the mounting bracket 68 into the slots 16 of the vertical standard of the wall panel 12. After the adaptor housing 26 is mounted in its desired position, the height adjustment mechanism 24 is inserted into the adaptor housing 26 as described above. The support arms 22 are secured to the top plate 38 of the height adjustment mechanism 24 and the work surfaces 18 are secured to the support arms 22.

After assembly, the work surfaces 18 can be moved vertically by either rotating the hand-crank 32 or energizing an electric motor (not shown). This action causes the rotation of the drive shaft 27 and transfer shafts 28, resulting in the rotation of the bevel gears 35. As the bevel gears 35 rotate with the shafts 28, the mating gear 48 correspondingly rotates which in turn rotates the drive screw 46. As the drive screw 46 rotates, the top plate 38, rails 40 and frame assembly 36 move vertically with respect to the trunnion plate 42 which is fixed by screws 88 to the adaptor housing 26, thereby vertically moving the work surfaces 18.

The two T-slots 64 in the adaptor housing 26 provide alternative channels to which to mount the mounting bracket 68. The adaptor housing 26 is thus used on either side of the work surface, thereby avoiding inventory for left and right adaptor housings. Further, the T-slots 64 give the adaptor a means for vertically adjusting the height of one side of a work surface with respect to the other side to compensate for uneven floors and uneven panel elevations. Thus, after installation, the adaptor housings can be adjusted slightly to make the work surface level even if the panel itself is not level.

It should be noted that the adaptor housing can also mount a fixed work surface to the wall panels by replacing the height adjustment mechanism with a suitable connector similar in shape and construction to the height adjustment mechanism for connecting the work surface to the adaptor housing.

Reasonable variation and modification are possible within the scope of the foregoing disclosure without departing from the spirit of the invention.

The embodiments for which an exclusive property or privilege is claimed are defined as follows:

1. An adaptor housing assembly for mounting an adjustable height work surface to a wall surface, the wall surface having a pair of vertical slotted standards mounted thereto and being adapted to mount a mounting bracket, the adaptor housing assembly comprising:

an adaptor housing having an elongated profile and comprising a pair of opposed sides and a pair of opposed ends which form a channel to mount a height adjustment mechanism the opposed ends defining a slot adjacent one of the sides and ends; and an elongated plate slidably mounted within the slot, and adapted to mount a mounting bracket to the adaptor housing in a multitude of vertically adjusted positions.

2. The adaptor housing assembly according to claim 1 wherein the adaptor housing further comprises a pair of elongated flanges extending outwardly from one of the opposed ends to form a slot for receiving a elongated plate.

3. The adaptor housing assembly according to claim 2 wherein the elongated plate has tapped holes to receive screws to mount the mounting bracket to the adaptor housing.

4. The adaptor housing assembly according to claim 3 wherein the adaptor housing further comprises a third elongated flange mounted on the opposed end adjacent the pair of elongated flanges to form a second slot to mount the elongated plate whereby the adaptor housing can be used for a left side or a right side support for a work surface.

5. The adaptor housing assembly according to claim 4 wherein the elongated flanges are shaped to form slots having a T-shape.

6. The adaptor housing assembly according to claim 5 wherein the adaptor housing is extruded.

7. The adaptor housing assembly according to claim 5 wherein the adaptor housing is roll-formed.

8. The adaptor housing assembly according to claim 1 wherein the elongated plate has tapped holes to receive screws to mount the mounting bracket to the adaptor housing.

9. The adaptor housing assembly according to claim 1 wherein the adaptor housing is extruded.

10. The adaptor housing assembly according to claim 1 wherein the adaptor housing is roll-formed.

11. A height adjustable work surface assembly for mounting to a wall having a pair of vertical slotted standards mounted thereto, the height adjustable work surface assembly comprising:

a work surface;

a height adjustment mechanism mounting the work surface for raising and lowering the work surface;

a mounting bracket having mounting hooks for engaging slots on a vertical slotted standard;

an adaptor housing for mounting the height adjustment mechanism to the mounting bracket, the adaptor housing having a profile receiving the height adjustment mechanism and further having an elongated fastening slot for receiving mounting brackets of different configurations; and a fastening member slidably mounted in the fastening slot for fixing the mounting brackets to the adaptor housing whereby the height adjustable work surface can be mounted to vertical standards of different configurations.

12. The height adjustable work surface assembly according to claim 11 wherein the adaptor housing has an elongated profile and comprises a pair of opposed sides and opposed ends to form a channel for mounting the height adjustment mechanism at a multitude of vertical positions with respect to the mounting bracket.

13. The height adjustable work surface assembly according to claim 12 wherein the adaptor housing further comprises a pair of elongated flanges extending outwardly from one of the opposed ends to form slot.

14. The height adjustable work surface assembly according to claim 13 wherein the fastening member comprises an elongated plate shaped to slide within the fastening slot.

15. The height adjustable work surface assembly according to claim 14 wherein the adaptor housing further comprises a third elongated flange mounted on the opposed end adjacent the pair of elongated flanges and forming a second slot to mount the elongated plate, whereby the adaptor housing can be used on either side of the work surface.

16. The height adjustable work surface assembly according to claim 15 wherein the elongated plate has tapped holes to receive screws to mount the mounting bracket to the adaptor housing.

17. The height adjustable work surface assembly according to claim 16 wherein the elongated flanges are shaped to form slots having a T-shape.

18. The height adjustable work surface assembly according to claim 17 wherein the adaptor housing is extruded.

19. The height adjustable work surface assembly according to claim 17 wherein the adaptor housing is roll-formed.

20. The height adjustable work surface assembly according to claim 11 wherein the fastening member comprises an elongated plate shaped to slidably mount within the adaptor housing.

21. The height adjustable work surface assembly according to claim 20 wherein the elongated plate has tapped holes to receive screws to mount the mounting bracket to the adaptor housing.

22. The height adjustable work surface assembly according to claim 11 wherein the adaptor housing has an elongated wall and further comprises a pair of elongated flanges extending outwardly from the elongated wall to form the fastening slot.

23. The height adjustable work surface assembly according to claim 11 wherein the adaptor housing is extruded.

24. The height adjustable work surface assembly according to claim 11 wherein the adaptor housing is roll-formed.

* * * * *